US005795851A

United States Patent [19]

Gerling et al.

[11] Patent Number: 5,795,851

[45] Date of Patent: Aug. 18, 1998

[54] PROCESS FOR TREATING METALS USING ANTI-CORROSION AGENTS AND CORROSION INHIBITORS CONTAINING LACTOBIONIC ACID AMIDES

[75] Inventors: Klaus Gerling, Winsen/Aller; Helge Rau, Burgdorf; Kornelia Wendler, Sehnde; Karlheinz Uhlig, Krefeld, all of Germany

[73] Assignee: Solvay Deutschland GmbH, Hanover, Germany

[21] Appl. No.: 908,809

[22] Filed: Aug. 8, 1997

[30] Foreign Application Priority Data

Aug. 8, 1996 [DE] Germany ..... 196 31 959.5

[51] Int. Cl.[6] ..... C10M 133/16; C10M 173/02

[52] U.S. Cl. ..... 508/307; 134/38; 42/42; 252/392

[58] Field of Search ..... 508/307; 72/42; 252/392; 134/38

[56] References Cited

U.S. PATENT DOCUMENTS

| | | | |
|---|---|---|---|
| 2,752,334 | 6/1956 | Walton . | |
| 5,296,588 | 3/1994 | Au et al. | 536/1.11 |
| 5,336,765 | 8/1994 | Au et al. | 536/18.5 |
| 5,670,474 | 9/1997 | Crawford et al. | 510/470 |

FOREIGN PATENT DOCUMENTS

| | | |
|---|---|---|
| 0550278 | 7/1993 | European Pat. Off. . |

*Primary Examiner*—Margaret Medley

*Attorney, Agent, or Firm*—Evenson, McKeown, Edwards & Lenahan, PPLC

[57] ABSTRACT

A process for inhibiting the corrosion of metals, in which the metals are treated with anti-corrosion agents, corrosion inhibiting agents or metal treating agents which are composed of or which contain lactobionic acid N-alkylamides and/or lactobionic acid alkylamine amides and/or di-lactobionic acid alkyl diamides, in which the saturated or unsaturated alkyl group bonded to the amide function has a chain length of more than 18 carbon atoms.

7 Claims, No Drawings

PROCESS FOR TREATING METALS USING ANTI-CORROSION AGENTS AND CORROSION INHIBITORS CONTAINING LACTOBIONIC ACID AMIDES

BACKGROUND OF THE INVENTION

The invention relates to a process for treating metals using lactobionic acid N-alkylamides and/or lactobionic acid alkylamine amides and/or di-lactobionic acid alkyl diamides in anti-corrosion agents and/or as corrosion inhibitors.

In many metal-processing operations, such as cutting, grinding or drilling, anti-corrosion agents are used in order to protect the machined metal objects from rusting. Many of the anti-corrosion agents usual hitherto contain sulfur-containing compounds such as petroleum sulfonates or alkylaryl sulfonic acids, or nitrogen-containing compounds such as secondary amines or alkanolamines. Sulfur-containing anti-corrosion agents here have the disadvantage that the active substances thereof are readily modified or broken down by sulfur-reducing microorganisms. In the case of amine-containing anti-corrosion agents, which contain in particular secondary amines, there is the possibility of nitrosamines, which are harmful to health and which have formed beforehand due to uncontrolled chemical reactions, being released therefrom. Thus, there remains a need for new anti-corrosion agents which do not have these disadvantages of the prior art. It would be particularly desirable to have anti-corrosion agents which contain as corrosion-inhibiting agent, an active substance composed of or derived from renewable raw materials, which is beneficial from an environmental point of view as well.

It is therefore an object of the present invention to provide a process for treating metals using novel anti-corrosion agents and corrosion-inhibiting agents.

It has been discovered that lactobionic acid N-alkylamides in which the saturated or unsaturated alkyl group bonded to the amide function has a chain length of more than 18, preferably 19–30, carbon atoms, lactobionic acid alkylamine amides in which the saturated or unsaturated alkyl group bonded to the amide function has a chain length of 8 to 30 carbon atoms, and di-lactobionic acid alkyl diamides in which the saturated or unsaturated alkyl group bonded to the amide functions, have a chain length of 8 to 30 carbon atoms, have a corrosion-inhibiting effect.

The invention thus relates to the use of the aforementioned compounds or mixtures thereof as anti-corrosion agents and/or as additives in metal-processing agents for treating metals. The treatment of the metals can be carried out by dipping, coating or spraying the metal objects to be treated in or with the anti-corrosion or corrosion-inhibiting agent.

In one embodiment of the invention, lactobionic acid N-alkylamides obtained by the reaction of lactobionic acid or reactive lactobionic acid derivatives, preferably lactobionic acid lactone, with a primary fatty amine mixture were used. "Primary fatty amines" in the scope of the present invention denotes primary amines which contain an aliphatic radical, corresponding to the aliphatic radical of a fatty acid, with more than 18 carbon atoms, in particular 19 to 30 carbon atoms. Fatty amines may, for example, be obtained industrially from fatty acids by first converting these into the corresponding nitrites, which are then reduced to form amines. Preferably fatty amine mixtures are used which are obtained from naturally-occurring or industrial fatty acid mixtures. The content of unsaturated fatty amines in this case varies in these fatty amine mixtures between approximately 5 and 85% by weight. For example, fatty amine mixtures obtained from rapeseed oil or castor oil or an industrial fatty acid mixture with a carbon chain length of more than 18 carbon atoms advantageously can be used.

In another embodiment of the invention, lactobionic acid alkylamine amides and/or di-lactobionic acid alkyl diamides, which have been obtained by the reaction of lactobionic acid or reactive lactobionic acid derivatives, preferably lactobionic acid lactone, with an α, Ω-primary diamine or an α, Ω-primary diamine mixture are used. α, Ω-primary fatty diamines which contain an aliphatic radical of a fatty acid with 8 to 30 carbon atoms are designated as α, Ω-primary diamines within the scope of the invention. These fatty diamines may for instance be obtained industrially from fatty acids, which are reacted in known manner to form the corresponding diamines. Preferably, fatty diamines or their mixtures, which have been obtained from naturally-occurring or industrial fatty acid mixtures, are used. The proportion of unsaturated fatty diamines in this case varies between about 5 and 85% by weight.

The desired amine amides or diamides are obtained by changing the stoichiometric ratio of lactobionic acid, or lactobionic acid lactone, to α, Ω-fatty diamine.

Lactobionic acid (=4-(β-D-galacto)-D-gluconic acid) and lactobionic acid lactone and the preparation thereof are already known. Lactobionic acid can, for example, be obtained in known manner by oxidation of lactose.

Preferably the metals are treated with an anti-corrosion agent which contains the lactobionic acid N-alkylamides and/or the lactobionic acid alkylamine amides and/or the di-lactobionic acid alkyl diamides in the form of an aqueous solution. The aqueous solutions may in this case be used on their own, or alternatively in a mixture with additional compounds as anti-corrosion agents or corrosion inhibitors. The content of lactobionic acid derivatives, relative to the aqueous solution, may in this case lie in the usual concentration range for anti-corrosion agents, advantageously in the concentration range of 0.01 to 20% by weight, desirably in the concentration range from 0.5 to 10% by weight.

The anti-corrosion agents or corrosion inhibitors which contain lactobionic acid N-alkylamides and/or lactobionic acid alkylamine amides and/or di-lactobionic acid alkyl diamides in an aqueous solution may be completely clear solutions or, in particular if other compounds are present, may be finely-distributed emulsions, which may be transparent, opaque or alternatively milky-opaque.

The lactobionic acid derivatives used according to the invention may be mixed with conventional compounds for anti-corrosion agents, e.g. petroleum sulfonates, mineral oils or other additives and then used for the treatment of the metals which are to be treated.

The lactobionic acid derivatives used according to the invention have an emulsifying and corrosion-inhibiting effect in aqueous metal-processing agents which contain mineral oil. The invention therefore also relates in particular to the use of such compounds in water-containing metal-processing agents. As used herein, the term "metal-processing agent" is to be understood to refer to any liquid conventionally used for metal processing, in particular cooling lubricants, drilling, cutting and grinding oils, rust-removing agents, paint-removing and passivating agents. It is therefore possible to produce metal-processing emulsions which contain water to a large extent, without rusting occurring. In addition to good protection against corrosion, the lactobionic acid derivatives used according to the invention are distinguished by excellent skin compatibility and a high degree of biodegradability.

The corrosion-inhibiting action of the lactobionic acid derivatives was determined by means of the chip/filter paper method in accordance with German Industrial Standard (Deutsche Industrie Norm) DIN 51360, Part 2.

The following examples are intended to illustrate the invention in further detail, without limiting its scope.

EXAMPLES

Example 1

Production of long-chained lactobionamides (N-tetracosyl-lactobionamide).

500 g (1.47 mole) lactobionic acid lactone were dissolved in approximately 1.6 liters of methanol at 50° to 60° C. 473 g (1.34 mole) tetracosylamine were introduced into this solution with stirring. After 12 hours reaction time at room temperature, the resulting light precipitate was filtered out, washed with methanol and dried in a vacuum drying cabinet at 40° to 50° C. The yield was 866 g N-tetracosyl-lactobionamide (corresponding to 89% of theoretical).

Example 2

Production of N-alkylamine lactobionamide (12-amino-dodecyl-lactobionamide).

500 g (1.47 mole) lactobionic acid lactone were dissolved in approximately 2 liters of methanol at 40° C. 200 g (1 mole) 1,12-diaminododecane were introduced rapidly into this solution. After 12 hours' reaction time, the resulting precipitate was filtered out, subsequently washed with methanol and dried in a drying cabinet. In order to remove di-lactobionic acid dodecyldiamide, an aqueous solution of the substance mixture was passed over an acidic ion-exchanger (e.g. IRA 252). The resultant solution contained excess lactobionic acid in addition to the unwanted diamide. After elution of the ion-exchanger with 2n $NH_4OH$ solution, after removal of the water and drying of the product in a vacuum drying cabinet 383 g 12-amino-dodecyl-lactobionamide were obtained (corresponding to 71% of theoretical).

Example 3

Production of di-lactobionic acid dodecyl-1,12-diamide.

500 g (1.47 mole) lactobionic acid lactone were dissolved in approximately 1.6 liters of methanol at 50° to 60° C. and 140 g (0.7 mole) 1,12-diaminododecane were added thereto. After 12 hours reaction time at room temperature, the resulting precipitate was filtered out, subsequently washed with methanol and dried in a vacuum drying cabinet at 40° to 50° C. 486 g di-lactobionic acid dodecyldiamide were obtained as a cream-colored powder (corresponding to 76% of theoretical).

Determination of Anti-Corrosion Properties:

The anti-corrosion properties were determined in accordance with German Industrial Standard DIN 51360, Part 2. Grey cast iron chips (material DIN 1691-GG30 of about 5 mm by 5 mm in size) were washed with petroleum ether, sieved through a wire sieve and dried in a drying cabinet at approximately 105° C. After drying, manual contact with the chips was avoided. A round filter made of filter paper (diameter 40 mm) was placed in a petri dish and was sprinkled evenly with 2 g (±0.1 g) of the dried chips. Then the chips were wetted evenly with 2 ml of the solution to be investigated by means of a transfer pipette. The lid of the petri dish was placed on top and the petri dish was allowed to stand for 2 hours at room temperature. Then the chips were removed from the round filter, the round filter was rinsed off under running water, swirled in acetone for about 5 seconds, and dried at room temperature. Immediately following the cleaning and drying of the round filter, the degree of corrosion of the corrosion surfaces on the round filter was established by visual inspection. In the following table, the degree of corrosion determined for the anti-corrosion agent according to the invention is given. In order to better assess the anti-corrosive properties of the test solutions, a reference test was performed using only pure tap water without any further additives. In each case, the anti-corrosion action for a 3% aqueous solution of N-tetracosyl-lactobionamide, 12-amino-dodecyl-lactobionamide and di-lactobionic acid dodecyl-1,12-diamide, prepared with tap water, was determined. The results are shown in the following Table I:

TABLE 1

| Test Solution | Degree of corrosion |
|---|---|
| Water | severe corrosion (degree of corrosion IV) |
| N-tetracosyl-lactobionamide (3% by weight in $H_2O$) | no corrosion (degree of corrosion 0) |
| 12-aminododecyl-lactobionamide (3% by weight in $H_2O$) | traces of corrosion (degree of corrosion 0-I) |
| di-lactobionic acid-dodecyl-1,12-diamide (3% by weight in $H_2O$) | no corrosion (degree of corrosion 0) |

The test results show that the anti-corrosion agents according to the invention have anti-corrosion properties which meet German Industrial Standard DIN 51360, Part 2.

The foregoing description and examples have been set forth merely to illustrate the invention and are not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for corrosion inhibition of a metal comprising contacting said metal with an aqueous composition or an oil-containing emulsion containing an effective corrosion-inhibiting amount of at least one lactobionic acid N-alkyl amide compound selected from the group consisting of lactobionic acid N-alkylamides having an amide function to which saturated or partially unsaturated alkyl groups having a chain length of more than 18 carbon atoms are bonded, lactobionic acid alkylamine amides having an amide function to which saturated or partially unsaturated alkyl groups having a chain length of 8 to 30 carbon atoms are bonded, and di-lactobionic acid alkyl diamides having amide functions to which saturated or partially unsaturated alkyl groups having a chain length of 8 to 30 carbon atoms are bonded.

2. A process according to claim 1, wherein said metal is contacted with an aqueous composition or an oil-containing emulsion comprising from 0.01 to 20 wt-% of at least one corrosion inhibiting compound selected from the group consisting of said lactobionic acid N-alkylamides, said lactobionic acid alkylamine amides and said di-lactobionic acid alkyl diamides.

3. A process according to claim 2, comprising from 0.5 to 10 wt-% of said at least one corrosion inhibiting compound.

4. A process according to claim 2, further comprising at least one substance selected from the group consisting of petroleum sulfonates and mineral oils.

5. A process according to claim 2, wherein said metal is contacted with said aqueous composition.

6. A process according to claim 1, wherein said metal is a ferrous metal.

7. A process according to claim 1, wherein said aqueous composition or oil-containing emulsion is a metal processing agent selected from the group consisting of cooling lubricants, drilling, cutting and grinding oils, rust-removing agents, paint-removing agents and metal passivating agents.

* * * * *